United States Patent [19]

Jennings, Jr.

[11] Patent Number: 4,787,452

[45] Date of Patent: Nov. 29, 1988

[54] DISPOSAL OF PRODUCED FORMATION FINES DURING OIL RECOVERY

[75] Inventor: Alfred R. Jennings, Jr., Plano, Tex.

[73] Assignee: Mobil Oil Corporation, New York, N.Y.

[21] Appl. No.: 59,357

[22] Filed: Jun. 8, 1987

[51] Int. Cl.[4] ..... E02D 3/12; E21B 33/138; E21B 43/24; E21B 43/40

[52] U.S. Cl. ..... 166/272; 166/266; 166/273; 166/292; 166/303; 405/258

[58] Field of Search ..... 166/266, 269, 272, 273, 166/292, 303, 305.1; 299/11; 405/258, 266, 267

[56] References Cited

U.S. PATENT DOCUMENTS

| | | | |
|---|---|---|---|
| 2,264,037 | 11/1941 | Haskell | 166/292 X |
| 2,390,770 | 12/1945 | Barton et al. | 166/266 X |
| 3,347,316 | 10/1967 | Havenaar | 166/292 |
| 3,373,814 | 3/1968 | Eilers et al. | 166/292 X |
| 3,839,899 | 10/1974 | McMillen | 73/38 |
| 3,918,521 | 11/1975 | Snavely et al. | 166/272 |
| 4,044,563 | 8/1977 | Hurst et al. | 299/11 X |
| 4,101,172 | 7/1978 | Rabbitts | 299/2 |
| 4,397,353 | 8/1983 | Lacy | 166/292 X |
| 4,452,491 | 6/1984 | Seglin et al. | 166/267 X |
| 4,470,462 | 9/1984 | Hutchison | 166/292 |
| 4,479,894 | 10/1984 | Chen et al. | 252/8.554 |
| 4,489,783 | 12/1984 | Shu | 166/272 |
| 4,501,329 | 2/1985 | De Priester | 166/292 |
| 4,513,821 | 4/1985 | Shu | 166/273 |
| 4,565,249 | 1/1986 | Pebdani et al. | 166/303 |
| 4,570,710 | 2/1986 | Stowe | 166/250 |

*Primary Examiner*—George A. Suchfield

*Attorney, Agent, or Firm*—Alexander J. McKillop; Michael G. Gilman; Charles A. Malone

[57] ABSTRACT

Recovered formation fines are pumped in slurry form into an injection well during an enhanced oil recovery process e.g. a steam flood. Said injection can be done incrementally in stages in conjunction with said process. Said fines improve the sweep efficiency of the injected medium. This method is also beneficial where steam breakthrough has occurred since the breakthrough path is in a fluid or semi-solid state thereby allowing the fines slurry to be injected.

12 Claims, No Drawings

DISPOSAL OF PRODUCED FORMATION FINES DURING OIL RECOVERY

FIELD OF THE INVENTION

This invention relates to the treatment of formations surrounding hydrocarbon production areas, oil wells, gas wells or similar hydrocarbon containing formations. It is particularly directed to the disposal of produced formation fines in combination with an enhanced oil recovery operation.

BACKGROUND OF THE INVENTION

Much of today's uncovered oil is in the form of viscous, low gravity crude oil found in shallow, low temperature reservoirs. These deposits of viscous oil are the target of substantial enhanced oil recovery efforts in the industry. Most of these reservoirs contain very high saturations of the viscous oil in a loosely consolidated or unconsolidated sandstone or siltstone matrix. A successful means of recovering the thick oil is to thin the oil thermally (steam or combustion) and produce the thinned oil to the surface. During production, substantial quantities of formation fluids and formation fines are produced to the surface, suspended in the crude oil. The produced fluid is then treated to separate the oil, water and solids.

The produced oil is then sold and the water is injected into water disposal wells, leaving the fines and formation sand. There is no present method or means for effective disposal of the fines.

Therefore, what is needed is a method to dispose of these produced fines in a beneficial way while avoiding an adverse environmental consequence.

SUMMARY

This invention is directed to a method for disposing of fines recovered during the production of hydrocarbonaceous fluids from a formation. In the practice of this invention, said fines are mixed with an aqueous saline solution in an amount sufficient to make a slurry. The slurry is injected into said formation at a rate and velocity sufficient to close pores in said formation without fracturing said formation. The salt concentration of the saline solution is held at a predetermined concentration so that pre-existing immobile formation fines will remain fixed. When at least one more permeable area of the formation has been sufficiently closed, an enhanced oil recovery operation is conducted to recover hydrocarbonaceous fluids from a less permeable area.

It is therefore an object of the present invention to dispose of fines obtained as a result of producing hydrocarbonaceous fluids from a formation.

It is another object of this invention to use recovered formation fines to close a more permeable area of a formation.

It is yet another object of this invention to desposit said recovered fines deep within the more permeable area of a formation thereby closing said area while maintaining the critical flow channels near a well.

It is a still yet further object of this invention to increase the production of hydrocarbonaceous fluids from a formation after closing a more permeable area in the formation.

DESCRIPTION OF PREFERRED EMBODIMENTS

The method of the present invention will work where there exists one wellbore from which the hydrocarbonaceous fluid is produced as well as where there are two different wellbores, i.e. an injection well and a production well. The method is also applicable to situations in which there exists hydrocarbonaceous fluid production, either in the liquid or gaseous state. Under proper circumstances, the method is equally applicable to removing hydrocarbonaceous fluids from tar sand formations.

Prior to practicing this invention, the critical salinity rate and the critical fluid flow velocity of the formation are determined. This determination is made via methods known to those skilled in the art. One such method is a method as set forth in U.S. Pat. No. 3,839,899 issued to McMillen and which is hereby incorporated by reference. The critical rate of salinity decrease can be determined as referenced in an article authored by K. C. Khilar et al. entitled "Sandstone Water Sensitivity: Existence of a Critical Rate of Salinity Decrease for Particle Capture", which appeared in Chemical Engineering Science, Volume 38, Number 5, pp. 789–800, 1983. This article is hereby incorporated by reference.

In the practice of this invention, an aqueous slurry containing fines is prepared. Fines utilized herein are preferably obtained during the production of hydrocarbonaceous fluids from a formation. These fines, including the clays, are entrained in the hydrocarbonaceous fluids when said fluids are produced to the surface. To keep damage from occurring to production equipment, these fines are removed by methods known to those skilled in the art. These recovered fines are mixed into an aqueous saline solution. An aqueous saline solution is utilized to prevent an uncontrolled migration of pre-existing formation fines into an area of lesser permeability. Fresh or relatively freshwater being foreign to the formation will often cause any pre-existing quiescent fines to be dispersed from their repository or loosen from adhesion to capillary walls. If an abrupt decrease in salinity should occur, a large number of clay particles, or fines can be released in a short time. This occurrence is avoided by the use of the saline solution herein. The effects of an abrupt decrease in salinity is discussed in U.S. Pat. No. 4,570,710 issued to Stowe which is incorporated by reference.

Salts, which can be employed in said saline solution include salts such as potassium chloride, magnesium chloride, calcium chloride, zinc chloride and carbonates thereof, preferably sodium chloride. While injecting an aqueous salt or saline solution of a concentration sufficient to prevent fines migration, and enough recovered fines to make a slurry, pressure is applied to the wellbore which causes the aqueous saline slurry to be forced deep within the formation. The depth to which the slurry is forced within the formation depends upon the presence exerted, the permeability of the formation, and the characteristics of the formation as known to those skilled in the art. In order to allow the fines or particles to migrate deeply within the formation, the critical fluid flow velocity of the slurrified fines is exceeded. This causes the fines to be transported in the saline solution to a location deep within the formation. Said slurry can be injected incrementally into an injection well where slugs containing a higher concentration of fines in the slurry follow a slug of lower fines concentration.

As used herein, the critical fluid flow velocity is defined as the smallest velocity of the saline solution which will allow fines or small particles to be carried by the fluid and transported within the formation or reservoir. Lower velocities will not entrain particles and will permit particles to settle from the solution.

Said slurry, entraining the recovered fines and having a saline concentration sufficient to prevent pre-existing formation fines from migrating into the formation, is injected into the formation at a rate and velocity sufficient to deposit fines in said slurry into a more permeable area of said formation. Said injection rate and velocity is kept below the rate and velocity required to fracture the formation. This rate and velocity however, is sufficient to carry the entrained fines in said slurry to a desired depth in said formation. When said slurry reaches the depth in the formation where it is desired to permanently deposit the fines, the flow of the saline solution is reduced below its critical fluid flow velocity. Such reduction causes fines entrained in said saline slurry to settle out thereby creating a "log jam" effect and plugging the more permeable areas of the formation. The permeability characteristics of the formation are determined prior to commencing the injection of the saline slurry solution. The "log jam" effect occurs because the fines after settling out adhere to the walls of the pores or channels deep within the formation.

Once the area in the formation having the higher permeability is substantially closed, an enhanced oil recovery operation is commenced. As is preferred, said enhanced oil recovery operation can comprise a stem flood, a carbon dioxide flood, or a solvent extraction method. This invention is particularly beneficial where zones of varying permeability exist in a formation. Such variations can occur naturally or can be created by prior enhanced oil recovery operations which cause "fingering", "gravity override", or "breakthrough" to a producing well. This method is particularly beneficial where steam breakthrough has occurred since the breakthrough path is in a fluid or semi-solid state thereby allowing the fines slurry to be injected. These variations can be corrected by this invention, and improved sweep efficiencies obtained.

Where it is desired to obtain increased sweep efficiency, the fines of this invention can be used to plug a previously sweep portion of a formation. Said fines in a saline aqueous slurry can be directed to areas of increased porosity in combination with any of the below methods.

One method where said slurrified fines of this invention can be utilized is during a waterflooding process for the recover of oil from a subterranean formation. Of course, said process must use water of salinity compatible with the formation. After plugging the more permeable zones of a reservoir with the novel fines of this invention, a waterflooding process can be commenced. U.S. Pat. No. 4,479,894, issued to Chen et al., describes one such waterflooding process. This patent is hereby incorporated by reference in its entirety.

Steamflood processes, which can be utilized when employing the slurrified fines described herein, are detailed in U.S. Pat. Nos. 4,489,783 and 3,918,521 issued to Shu and Snavely, respectively. These patents are hereby incorporated by reference herein.

Slurrified fines described herein can also be used in conjunction with a cyclic carbon dioxide steam stimulation in a heavy oil recovery process to obtain greater sweep efficiency. Cyclic carbon dioxide steam stimulation can be commenced after plugging the more permeable zones of the reservoir with the novel fines of this invention. A suitable process is described in U.S. Pat. No. 4,565,249 which issued to Pebdani et al. This patent is hereby incorporated by reference in its entirety. Increased sweep efficiency can be obtained when the slurrified fines are used in combination with a carbon dioxide process by lowering the carbon dioxide minimum miscibility pressure (MMP") and recovering oil. Prior to commencement of the carbon dioxide process, the more permeable zones are plugged with fines contained in the slurry. Carbon dioxide MMP in an oil recovery process is described in U.S. Pat. No. 4,513,821 issued to Shu which is hereby incorporated by reference.

The slurrified fines of this invention need not be injected continuously. A preferred method is to inject the slurrified fines followed by a spacer volume of a saline solution. Once the slug of slurrified fines has reached the desired location, pressure is released which allows the fines to settle out and plug pores within the formation. This process can be repeated until the permeability of the formation has been decreased to the extent desired.

Obviously, many other variations and modifications of this invention, as previously set forth, may be made without departing from the spirit and scope of this invention as those skilled in the art readily understand. Such variations and modifications are considered part of this invention and within the purview and scope of the appended claims.

What is claimed is:

1. A method for disposing of fines recovered during the production of hydrocarbonaceous fluids from a formation comprising:

(a) making an aqueous saline slurry from said recovered fines;

(b) injecting incrementally said slurry into a formation via at least one wellbore at a rate and velocity sufficient to close pores in said formation without fracturing said formation where a slug containing a higher concentration of fines in the slurry follows a slug of lower fines concentration; and (c) decreasing the injection rate and velocity of said slurry thereby causing said fines to settle and close at least one more permeable zone in said formation.

2. The method as recited in claim 1 where at least one injector well is utilized which well can also serve as a producer well.

3. The method as recited in claim 1 where steam breakthrough has occurred in said formation to produce a more permeable zone.

4. The method as recited in claim 1 where an enhanced oil recovery operation comprising a water flood, a steam flood, or carbon dioxide flood is utilized subsequent to step (c).

5. A method for improving the sweep efficiency of an enhanced oil recovery operation comprising:

(a) making an aqueous slurry from fines recovered from hydrocarbonaceous fluids produced from a formation;

(b) directing incrementally said slurry into said formation via at least one wellbore at a rate and pressure below that required to fracture said formation but which is sufficient to cause fines to close at least one previously swept area in said formation where a slug containing a higher concentration of fines in the slurry follows a slug of lower fines concentration; and (c) decreasing the injection rate and velocity of said slurry thereby causing said fines to settle and close at least one previously swept zone in said formation.

6. The method as recited in claim 5 where said slurry is directed into said formation by at least one injector well which well can also serve as a producer well.

7. The method as recited in claim 1 wherein said enhanced oil recovery operation comprises a waterflood, a steam flood, or a carbon dioxide flood.

8. The method as recited in claim 5 where in step (b) said previously swept zone results from gravity override during a carbon dioxide oil recovery method.

9. The method as recited in claim 5 where in step (b) said previously swept zone results from steam breakthrough during a steam flood oil recovery operation.

10. The method as recited in claim 5 where in step (b) said previously swept zone results from said formation having at least one zone of greater permeability and at least one zone of lesser permeability.

11. The method as recited in claim 5 where said slurried fines followed by a spacer volume of saline solution are injected into the formation intermittently and the pressure is released.

12. The method as recited in claim 5 where the critical fluid flow velocity of said fines is exceeded which allows said fines to migrate deeply into the formation.

* * * * *